United States Patent [19]

Letemps et al.

[11] Patent Number: 4,878,850

[45] Date of Patent: Nov. 7, 1989

[54] ELECTRIC POWER SUPPLY TERMINAL FOR ENCAPSULATED GLAZING

[75] Inventors: Bernard Letemps, Thourotte; Gérard Huchet, Retheuil; Jacques Leclercq, Roisel, all of France

[73] Assignee: Saint-Gobain Vitrage, Courbevoie, France

[21] Appl. No.: 219,395

[22] Filed: Jul. 15, 1988

[30] Foreign Application Priority Data

Jul. 15, 1987 [FR] France ..... 87 09915

[51] Int. Cl.[4] ..... H01R 9/09

[52] U.S. Cl. ..... 439/83; 439/874; 439/935; 338/322; 338/327; 219/203; 219/522

[58] Field of Search ..... 439/83, 604, 606, 876, 439/935; 219/203, 520–522; 338/313, 322, 327

[56] References Cited

U.S. PATENT DOCUMENTS

| | | | |
|---|---|---|---|
| 3,745,309 | 7/1973 | Gruss | 219/522 |
| 4,029,942 | 6/1977 | Levin | 219/522 |
| 4,246,467 | 1/1981 | Boaz | 439/874 |
| 4,443,691 | 4/1984 | Sauer | 219/522 |
| 4,721,845 | 1/1988 | Kunert et al. | 338/322 |

*Primary Examiner*—P. Austin Bradley

*Attorney, Agent, or Firm*—Oblon, Spivak, McClelland, Maier & Neustadt

[57] ABSTRACT

The terminal for encapsulated glazing having coverings or equipment requiring an electric power supply. The terminal, for example of the hollow rivet type, is fastened, particularly by soldering or brazing, in the area of the edges of the glazing on a zone having a conductive covering, embedded in the encapsulation material of the glazing. The terminal makes it possible to supply power to the heating glazings.

13 Claims, 1 Drawing Sheet

ELECTRIC POWER SUPPLY TERMINAL FOR ENCAPSULATED GLAZING

BACKGROUND OF THE INVENTION

1. Field of the Invention:

This invention relates to an encapsulated glazing supplied electrically and more precisely an electric power supply terminal for encapsulated glazing having coverings or equipment requiring an electric power supply.

2. Description of the Background:

Terminals used with standard glazings, i.e., not encapsulated, as, for example, those described in patent document FR 1527738 are not compatible with an encapsulation of the glazings, i.e., incorporation of said glazings in a framework of polymerized organic material produced by molding on the periphery of said glazings. The electric terminals would be embedded in the polymerized material and first would have to be bared for the electrical connection to be made.

Further, these standard terminals are generally rather fragile and perhaps would not support the baring operation without damage.

Moreover, such would damage the encapsulation frame.

SUMMARY OF THE INVENTION

This invention proposes an electrical terminal for encapsulated glazing, easy to put in place, not requiring the baring operation after encapsulation, and of such low cost that it is conceivable to equip systematically all encapsulated glazings able to be supplied electrically, whether these glazings are actually supplied or not, the unused terminal not spoiling the esthetics of the glazing and not causing any problems. This terminal can also be used for nonencapsulated glazings.

The terminal according to the invention consists of a hollow rivet or a snap fastened to assure the electrical connection on a conductive zone deposited on the glazing.

In the case of an encapsulated glazing, the terminal is fastened on a conductive zone of the glazing, on the edge of the glazing and is embedded in the encapsulation polymer of the glazing so that it is flush with the outside surface of the encapsulation material forming the frame around the glazing.

Advantageously, this terminal is a female terminal consisting of a hollow rivet whose flared part is fastened to the glazing and of which the end of the narrowed opposite part is flush with the surface of the encapsulation material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
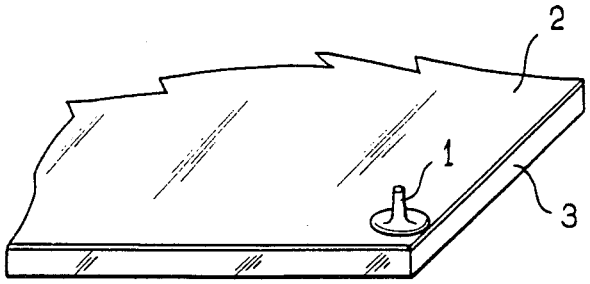
FIG. 1 shows the soldering of a terminal in the form of a hollow rivet on the edge of a glazing totally or partially covered by a conductive deposit.

The invention is particularly suitable for supplying electric power to encapsulated glazings covered on all or part of their surface with electrically conductive deposits.

These deposits are conductive strips made by silk screening or electroplating, and/or thin layers of metal or metal oxides. As thin layers there can be cited layers of tin oxide, of ITO (indium tin oxide), stacks of layers of the tin oxide/Ag/tin oxide type. The invention also relates to conductive layers other than those given by way of example. The glazings thus coated are used both in the automobile industry and the building industry.

There can be utilized deposits and/or heating layers, anti-break-in (i.e., whose break in the electrical continuity and/or modification of the electric resistance, or field leak effect, i.e., IR nonreflection, as result of a break following a break-in triggering a warning signal of the break-in or an action), with a radio antenna function, or with the function of a remote-control IR signal receiver.

According to the invention, a terminal 1 is fastened to a conductive deposit 2 covering all or part of a glazing 3, this conductive deposit being, as already stated, a silk-screened deposit and/or a thin metal layer (metal or metal oxide). This terminal 1 is fastened to a part of the deposit flush with the edge of glazing 3 intended to be embedded later by an encapsulation frame of polymerized organic material 7.

To guarantee proper securing of this terminal 1 and a good electric contact with conductive deposit or layer 2, this terminal is soldered or brazed with tin.

Figure 4:
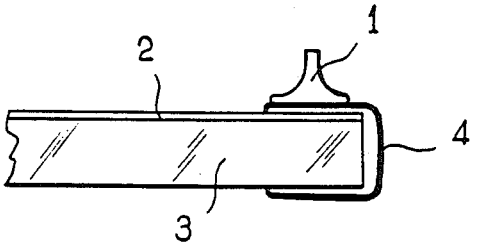
FIG. 4 shows a terminal associated with a clamp.

However, other modes of fastening are also possible. By way of nonlimiting example it is possible to associate terminal 1 with a clamp 4 (FIG. 4) intended to overlap the section of glazing 3 having on at least one face the conductive deposit and/or film 2, the clamp exerting a spring effect which guarantees the electric contact and good holding even before its embedding by the material of the encapsulation frame.

This clamp 4 is of small dimensions so as to be able to be inserted in the encapsulation mold and not form a bothersome projection after encapsulation of the glazing.

The height of this terminal 1 is provided so as to be of the same order of magnitude as the thickness of the encapsulation frame, so that access to this terminal does not require any baring of polymerized material, so that also this terminal does not form a projection, bothersome for the esthetics of the glazing, for mounting or handling the glazing, for production of the encapsulation frame and insertion of the glazing thus equipped in the mold used to produce this frame.

Figure 2:
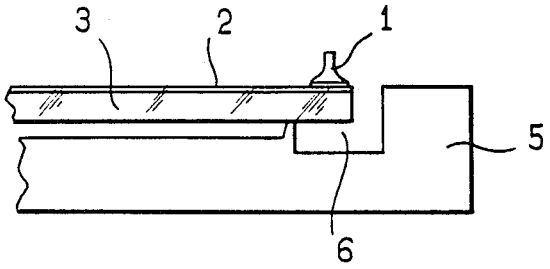
FIG. 2 shows placing of the glazing equipped with its electric power supply terminal into an encapsulation mold.
Figure 3:
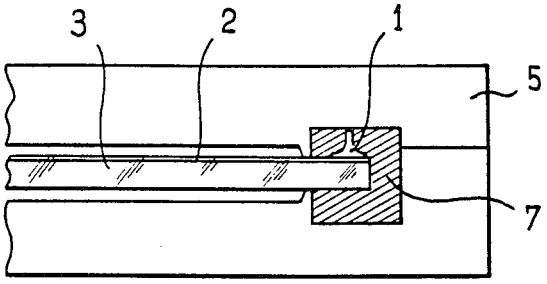
FIG. 3 shows production of the encapsulation frame and surrounding of the terminal with the material of the encapsulation frame.

Various forms of terminals are possible; a hollow rivet of the type of that represented in FIGS. 1 to 3, a male or female, but preferably female, snap, etc. However, the hollow rivet represented in FIGS. 1 to 3 offers the advantage of having an enlarged base such that it can easily be soldered and also so that a good electric contact can be made, of having a narrowed opposite end not detracting from the esthetics, and of being a very inexpensive popular product.

As shown in FIG. 2, glazing 3, equipped with its terminal 1, for example in the form of a hollow rivet, is placed in an encapsulation mold 5, the edge of glazing 3 equipped with its terminal 1 then being in the enlarged space 6 of mold 5 (FIG. 3) on the inside of which will later be injected or poured the organic material 7 intended to constitute the encapsulation frame. After production of the encapsulation frame, the encapsulated glazing is removed from the mold.

Terminal 1 is embedded in the organic material, which reinforces its holding, avoids degradation as a result of impacts, and prevents corrosion and deterioration of the electric contact. Connection of terminal 1 to an electric power supply is simply made by connecting a plug in terminal 1, of the male banana type in case of a terminal 1 in the form of a rivet.

Optionally, the connection of this plug can require penetration of a film of organic material which would cover the cap of the rivet.

The glazing to which this terminal can be fastened is a single or multiple glazing. In the above text mention has been made of only a single terminal per glazing, but, of course, a plurality of such terminals can very well equip the same glazing.

In this text, the electric terminal has been described as being placed on the edge of the glazing in a zone intended to be embedded in the material of the encapsulation frame. Of course, terminals such as hollow rivets or snaps fastened solidly by brazing or soldering on a glazing in a conductive zone, can also be in other parts than on the edges of said glazing, for example, in the areas of the center of the glazing, whether this glazing is encapsulated or not.

These terminals have been described as used for electric power supply of conductive deposits made on the glazing, but they can also be used for electric power supply of electric elements incorporated in the glazing or attached to or associated with the glazing, for example, lighting (lamps, lights) of various electric instruments. Of course, incorporation of these terminals in the encapsulation material makes them invisible or almost so, reinforces their protection relative to impacts and corrosion, and therefore offers various advantages; but this is not essential.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electric power supply terminal for a glazing having an electrically conductive deposit and provided with electrical equipment, comprising:

terminal fastening means for assuring electrical connection on a conductive zone deposited on the glazing; and means for fastening said terminal to a zone on an edge of the glazing covered with said conductive deposit, wherein the glazing is at least partially embedded in an encapsulation frame and said electric power supply terminal is embedded in said encapsulation frame so that said terminal is flush with an outside surface of said encapsulation frame.

2. The electric power supply terminal according to claim 1, wherein said fastening means comprises a snap fastened by a base portion thereof to a conductive zone deposited on the glazing.

3. An electric power supply terminal according to claim 1, wherein said fastening means comprises soldering means.

4. An electric power supply terminal according to claim 1, wherein said fastening means comprises means for brazing the terminal to the conductive zone deposited on the glazing.

5. An electric power supply terminal according to claim 1, wherein said fastening means comprises clamping means for clamping an edge of the glazing in a zone covered by a conductive deposit.

6. An electric power supply terminal according to claim 1, wherein said glazing comprises a single layer glazing.

7. An electric power supply terminal according to claim 1, wherein said glazing comprises a multiple layer glazing.

8. An electric power supply terminal according to claim 1, wherein said glazing comprises a heated glazing having a metal layer and/or soaked-screen conductive strips.

9. An electric power supply terminal according to claim 1, wherein said glazing comprises radio antenna glazing.

10. An electric power supply terminal according to claim 1, wherein said glazing comprises glazing having an anti-break-in layer.

11. An electric power supply terminal according to claim 1, wherein said glazing comprises IR signal receiving glazing.

12. The electric power supply terminal according to claim 1, wherein said terminal comprises a female terminal.

13. The electric power supply terminal according to claim 12, wherein said terminal comprises a hollow rivet having a flared part fastened to the glazing and of which an end of a narrowed opposite part is flush with the surface of the encapsulation frame.

* * * * *